United States Patent [19]

Holmes

[11] 3,972,090

[45] Aug. 3, 1976

[54] SELF-LATCHING HINGE

[75] Inventor: Frank A. Holmes, Ventura, Calif.

[73] Assignee: Jaybee Manufacturing Corporation, Los Angeles, Calif.

[22] Filed: June 19, 1975

[21] Appl. No.: 588,217

[52] U.S. Cl. ..... 16/139; 16/50; 16/72; 16/142; 16/180; 16/140

[51] Int. Cl.[2] ..... E05D 11/10

[58] Field of Search ..... 16/139, 140, 142, 146, 16/147, 150, 72, 73, 50, 85, 180, 190, 191

[56] References Cited

UNITED STATES PATENTS

| | | | |
|---|---|---|---|
| 3,255,484 | 6/1966 | Mac Donald | 16/180 |
| 3,262,149 | 7/1966 | Gorton et al. | 16/147 |
| 3,381,333 | 5/1968 | Jerila | 16/139 |
| 3,391,420 | 7/1968 | Anderson | 16/139 |
| 3,550,186 | 12/1970 | Swartz | 16/180 |
| 3,623,185 | 11/1971 | Cartwright et al. | 16/142 |
| 3,822,440 | 7/1974 | Holmes et al. | 16/142 |

*Primary Examiner*—G. V. Larkin
*Attorney, Agent, or Firm*—Flam & Flam

[57] ABSTRACT

A springless self-latching hinge is provided having a pair of hinge members pivotally connected by a hinge pin and formed of resilient material configured to snap the hinge closed and to releasably maintain the hinged closed. The first hinge member includes a pair of raised, spaced hinge pin receiving knuckles and a boss protruding toward the pin. The second hinge member has a hinge knuckle incompletely encircling the pin and forming a bearing sleeve. A portion of the bearing sleeve forms an exterior, concave cam which is compressed against the boss as the hinge is operated. The compression between the boss and the sleeve is a maximum just prior to closure of the hinge and is maintained at less than maximum when the hinge is fully closed. The hinge thus snaps closed after partial closure and is held releasably closed until sufficient effort is exerted to rotatably open the hinge against the force of the resilient members.

10 Claims, 4 Drawing Figures

SELF-LATCHING HINGE

BACKGROUND OF THE INVENTION

1. Field of the Invention

The present invention relates to self-latching hinges, and particularly to such hinges wherein the latching force and part of the closing force is provided by the resilience of the hinge leaves.

2. Description of the Prior Art

Self-latching hinges have gained widespread acceptance in the building industry for use in the installation of cabinet doors and the like. Such hinges include a force providing mechanism which maintains the cabinet door closed and which assists in closing the door without the need for a separate latch or spring. Use of self-latching hinges eliminates both the cost of additional latch hardware and the even greater expense of installing such additional hardware.

In typical prior art self-latching hinges, a spring biased roller or wedge incorporated in one hinge leaf presses strongly against a notched hinge pin bearing sleeve on the other leaf. As the hinge members are rotated toward the door-closing position, the roller or wedge engages the bearing sleeve notch to then force the hinge closed. Some effort is required to open the hinge against the biasing force.

In most self-latching hinges of the type described, the roller or wedge biasing force is provided by a separate spring element mounted on one hinge leaf. Assembly is complicated because the spring must be highly prestressed to ensure that the cabinet door fully closes and because the spring acts at a very small distance from the hinge axis. Both hinge leaves must be formed of relatively thick metal to withstand this substantial spring force. One object of the present invention is to provide a self-latching hinge requiring no such spring element.

Another shortcoming of prior art self-latching hinges is the manner of attachment to the frame or closure. Most commonly, one of the metal hinge leaves was fastened by screws to the cabinet or door frame. By providing a hinge wherein one leaf may be formed of plastic, alternative means for attachment are available.

SUMMARY OF THE INVENTION

A self-latching hinge is provided having a pair of hinge members pivotally connected for angular movement by a hinge pin. One hinge member is composed of a flexible, resilient material and is rigidly secured to a cabinet to limit flexure of the one hinge member. Interacting parts of the hinge members develop stress in the one hinge member as a function of the angular movement with the stress being maximized just prior to closure of the hinge and being maintained at a level less than maximum when the hinge is closed. The hinge is thus provided with a snap closing action and is resiliently maintained closed.

In one embodiment of the invention, the one hinge member is a unitary leaf formed of a resilient material, such as molded plastic, having a base portion and including a pair of spaced hinge pin receiving knuckles extending from the base portion. The other hinge leaf member is also formed of a resilient material such as metal, and has a hinge knuckle terminating at a bearing sleeve which incompletely encircles the pin a portion of which defines an exterior concave cam surface. A detent or boss projects from the base portion to engage the cam when the hinge is closed and is in the process of being closed. As the hinge is opened from the closed position, the resilient members are first increasingly flexed and then return to an unstressed position. Thus, the hinge is releasably maintained closed and snaps closed after partial closure.

BRIEF DESCRIPTION OF THE DRAWINGS

In the drawing which constitutes part of the specification, exemplary embodiments demonstrating the various features of this invention are set forth wherein.

DESCRIPTION OF THE PREFERRED EMBODIMENTS

Figure 1:
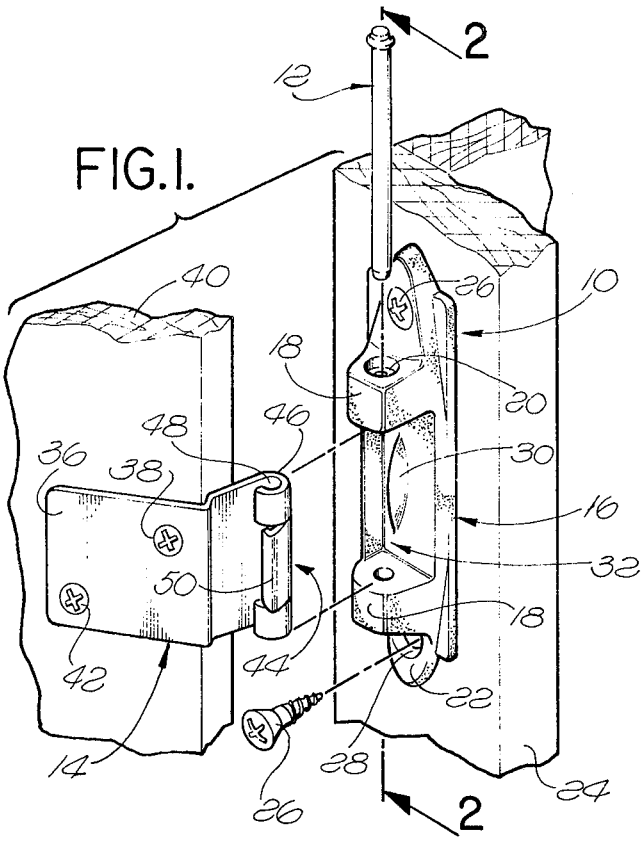
FIG. 1 is an exploded perspective view of one embodiment of the self-latching hinge of the present invention installed on a cabinet frame and door.

The following detailed description is of the best presently contemplated mode of carrying out the invention. This description is not, however, to be taken in a limiting sense, but is made merely for the purpose of illustrating the general principles of the invention since the scope of the invention is best defined by the appended claims.

In the embodiment of the invention shown and described herein, a first hinge member 10, adapted to be secured to a cabinet frame 24 or the like, provides a pair of spaced hinge pin receiving knuckles 18 having coaxial openings 20 and a latch element in the form of a rounded resilient boss 30 extending toward the hinge pin 12 from between the pin receiving knuckles. The second hinge member 14 provides a mounting plate 36 adapted to be secured to a door 40 or the like, and an extending hinge knuckle 44 having a curled end 46 which partially encircles the hinge pin 12. A companion latch element in the form of a resilient cam 50 extends from the curled end 46 to engage the boss 30 during angular movement of the leaves with respect to each other. Maximum compression between the cam and boss is achieved just prior to closure of the hinge while a compression somewhat less than maximum is achieved when the hinge is fully closed. The hinge of this invention thus provides a partial snap closing action and is resiliently maintained in the closed position by compression between the boss 30 and cam 50.

Referring now specifically to FIGS. 1–4, the three main parts of this embodiment of the invention are a first member 10, formed integrally of a resilient material such as molded plastic, Nylon, Teflon, or the like, a rigid elongated hinge pin 12 composed of brass, steel or the like, and a second hinge member 14, formed integrally of a resilient material such as heat-treated steel or the like.

The molded plastic hinge leaf member 10 includes a base portion 16 from which projects a pair of spaced apart knuckles 18 having coaxial openings 20 for receiving the hinge pin 12. The ends of the base portion having integral mounting members in the form of flanges, fasteners or ears 22 for mounting the first hinge member 10 to a cabinet frame 24 or the like, as by screws 26 extending through holes 28 in the mounting flanges 22. A rounded convex detent or boss 30 extending from the central region 32 of the first hinge member base 16 extends generally toward the longitudinal axis X—X of the pin 12 positioned in the coaxial openings 20. At least the boss 30 is composed of a material which combines the qualities of strength and flexibility with a certain smoothness or lubricity which is effective to facilitate sliding action between the boss and the cam 50, as will be described hereinafter.

Figure 2:
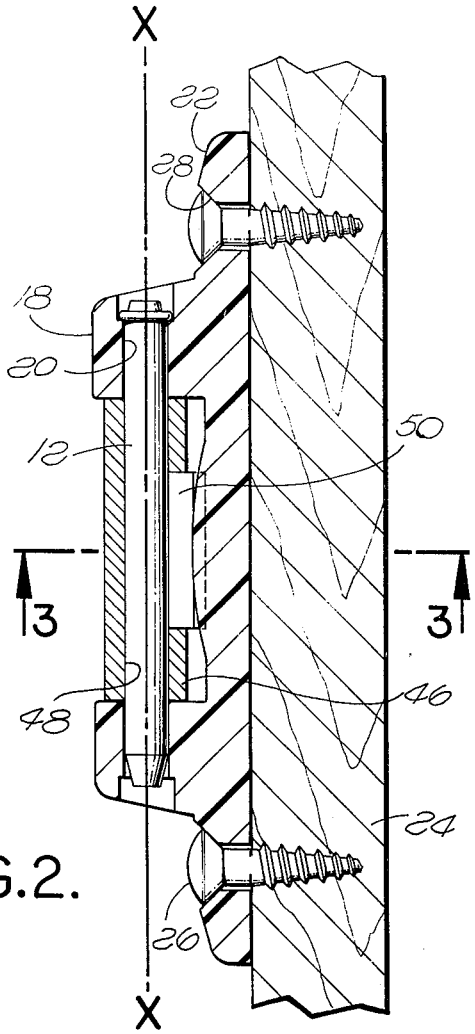
FIG. 2 is a partially cross-sectional, elevational side view taken along the line 2—2 of FIG. 1 with the hinge elements assembled and the hinge closed.
Figure 3:
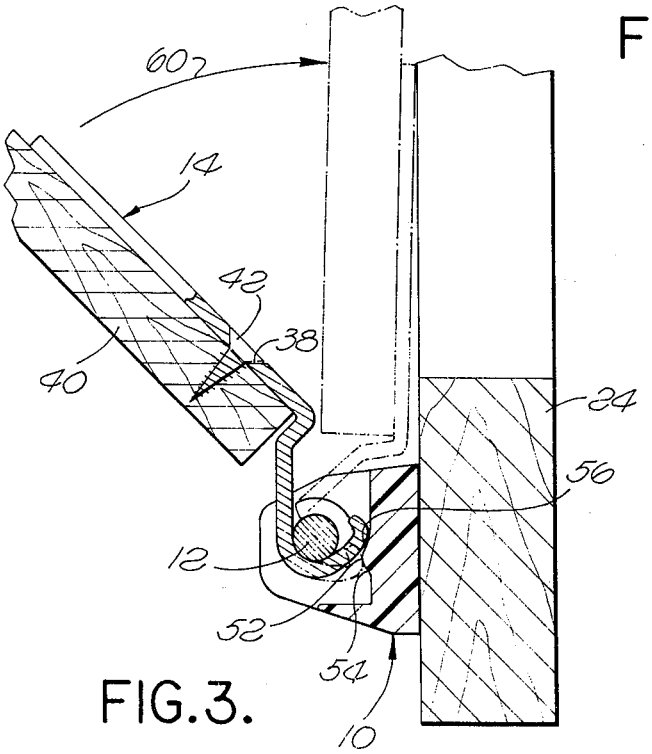
FIG. 3 is a cross-sectional view of the hinge taken along the line 3—3 of FIG. 2, showing the hinge as it begins to close and, in phantom, showing the hinge in its closed position.
Figure 4:
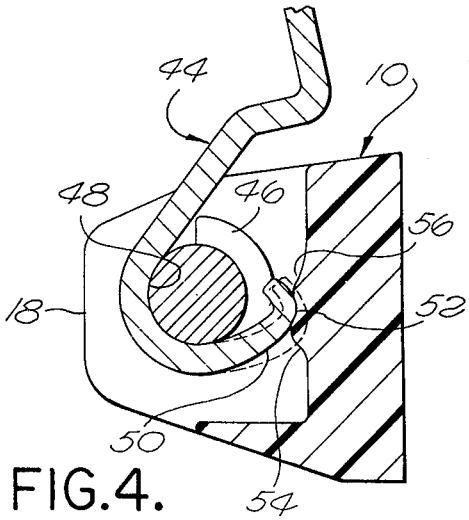
FIG. 4 is an enlarged fragmentary cross-sectional view of the hinge shown in FIG. 3 with the hinge at the position of maximum compression.

With the hinge members assembled and the leaves secured for coaction as previously described and as is shown in FIGS. 2–4, the door 40 and leaf 14 mounted therein are pivoted clockwise (as viewed in FIG. 3) about the hinge pin 12 to close the hinge. FIG. 3 shows the hinge in the position where compression between the cam 50 and boss 30 just begins upon closing the hinge. FIG. 3 also shows in phantom the fully closed position of the hinge, which requires clockwise rotation of the door 40 and hinge leaf 14 as indicated by arrow 60. As the hinge is closed by rotation in the direction of arrow 60, the cam 50 bears against the boss 30 to compress both the cam and the boss until the apex 52 of the boss is passed, whereupon compression between the cam and boss rapidly diminishes until the hinge is closed as shown in phantom in FIG. 3. Thus, to open or close the hinge, sufficient effort must be exerted to achieve the maximum compression between the cam 50 and the apex 52 of the boss 30.

This point of maximum compression is shown in greater detail in FIG. 4. The deformation of the cam and boss are exaggerated and the uncompressed position of the cam is shown in phantom in FIG. 4 for purposes of illustration.

The boss 30 has inclined front and rearward faces 56 and 54 which meet at apex 52. The rearward face 54 slopes more steeply than the front face 56 and the apex is positioned slightly rearward of a vertical plane to the longitudinal axis X—X of the pin 12. Compression between the boss and the cam will thus decrease rapidly as the hinge rotates from the position of maximum compression, shown in FIG. 4, to the fully closed position, shown in phantom in FIG. 3. This rapid decrease in compression gives the hinge its snap closing quality. The compression will decrease more slowly, however, as the hinge is rotated from the position of maximum compression to the fully open position.

There exists a residual amount of compression between the boss 30 and the cam 50 when the hinge is fully closed in order to provide a force which tries to even more fully close the hinge. Such a residual closing force prevents rattling of cabinet doors and the like.

In another embodiment of the invention, the amount of flexibility of either the boss or the cam or both may be varied to increase or decrease the displacement of either or both. For example, in some instances it may be more desirable for the cam to undergo more deformation upon angular rotation while the boss is not deformed.

What is claimed is:

1. A self-latching hinge comprising:

a pair of hinge members pivotally connected by a hinge pin;

one hinge member having a hinge knuckle which incompletely encircles said pin to define a bearing sleeve, said bearing sleeve having an exterior cam surface;

the other hinge member being formed of a resilient material and including a spaced pair of hinge pin receiving knuckles separated by a base portion having a boss extending toward said hinge pin to engage said bearing sleeve cam surface when said hinge is closed, said bearing sleeve and said boss being compressed against each other when said hinge is closed, the resilience of said boss thereby acting to releasably maintain said hinge closed;

said knuckles, said base portion and said boss of said resilient hinge member forming a one-piece integral structure.

2. A self-latching hinge as defined in claim 1 wherein said resilient hinge member further comprises at least one integral mounting member projecting therefrom.

3. A self-latching hinge as defined in claim 1 wherein the width of said boss is less than the distance between said pin receiving knuckles, and wherein said boss and said sleeve cam surface each have a convex curvature.

4. A self-latching hinge as defined in claim 1 wherein the bearing sleeve of said one hinge member is resilient metal.

5. A self-latching hinge, comprising:

a hinge pin, a unitary first hinge member of resilient material comprising a base portion having a central region, a pair of spaced knuckles projecting from said base portion and having coaxial openings receiving said hinge pin therethrough and a force transmitting boss between said knuckles extending generally toward said pin;

said base portion and said boss forming a one-piece integral structure;

and a unitary second hinge member of resilient material comprising a mounting plate; and a hinge knuckle extending from said mounting plate;

the remote end of said hinge knuckle being curled to form a hinge pin bearing sleeve at least partially encircling said pin;

said bearing sleeve having an exterior cam surface which is compressed against said boss as the hinge members approach a closed position to create maximum stress in said sleeve and boss just prior to arrival of said hinge members at said closed position and to maintain a less than maximum amount of stress at said closed position;

the resilience of said hinge members thereby releasably urging said hinge closed at said closed position.

6. A self-latching hinge as defined in claim 5 wherein said first hinge member includes integral mounting members projecting therefrom.

7. A self-latching hinge structure, comprising:

a pair of hinge members;

one of said hinge members having a latch element made of resilient plastic material protruding toward the other hinge member;

the other of said hinge members having a resilient metal latch element positioned to interact with said latch element of said one hinge member;

said latch elements having a configuration to provide a snap closing under the influence of the resilient interaction of said latch element; and a pair of spaced apart fasteners connected to said one hinge member for confining the ends thereof against movement during interaction of said latch elements;

said latch elements achieving maximum compression against each other just prior to arrival of the hinge at the closed position and maintaining a less than maximum compression against each other at the closed position to provide a snap closing and to maintain a positive closure of said hinge.

8. The self-latching hinge as defined in claim 7 in which said hinge members are substantially unstressed when the hinge is in the fully open position.

9. The self-latching hinge structure as defined in claim 7 wherein said one hinge member is a one-piece plastic unit adapted to be rigidly secured to a cabinet structure by said pair of fasteners.

10. The self-latching hinge structure as defined in claim 7 in which said protruding latch element has a convex surface adopted to contact said metal latch element and is at all times supported at its under surface when mounted on a cabinet structure.

* * * * *